US005673012A

United States Patent [19]

Stadler et al.

[11] Patent Number: 5,673,012

[45] Date of Patent: Sep. 30, 1997

[54] POLARIZED ELECTROMAGNETIC RELAY

[75] Inventors: Heinz Stadler, Munich; Michael Dittmann, Berlin, both of Germany

[73] Assignee: Siemens Aktiengesellschaft, Munich, Germany

[21] Appl. No.: 659,048

[22] Filed: Jun. 3, 1996

[30] Foreign Application Priority Data

Jun. 1, 1995 [DE] Germany ..... 195 20 220.1

[51] Int. Cl.[6] ..... H01H 51/22

[52] U.S. Cl. ..... 335/78; 335/128

[58] Field of Search ..... 335/76–86, 124, 335/228

[56] References Cited

U.S. PATENT DOCUMENTS

| | | | |
|---|---|---|---|
| 4,307,362 | 12/1981 | Kobler et al. . | |
| 5,015,978 | 5/1991 | Yokoo et al. | 335/128 |
| 5,117,209 | 5/1992 | Sato | 335/78 |
| 5,153,543 | 10/1992 | Hitachi et al. | 335/78 |

FOREIGN PATENT DOCUMENTS

| | | |
|---|---|---|
| 27 23 430 | 11/1978 | Germany . |
| 34 30 589 | 2/1986 | Germany . |
| 39 38 226 | 5/1991 | Germany . |
| 44 10 285 | 9/1995 | Germany . |
| 94/22156 | 9/1994 | WIPO . |

*Primary Examiner*—Lincoln Donovan
*Attorney, Agent, or Firm*—Hill, Steadman & Simpson

[57] ABSTRACT

The relay has a rocker armature (3) arranged between a base (1) and a coil (7), which is drawn respectively into one of two switching positions by a permanent magnet (55). Contact springs (34) that work together with the fixed contacts (14) anchored in the base are connected with the permanent magnet. For the stabilization of the construction and for the division between a contact chamber (4) and a coil chamber (6), a main body, preferably with an H-shaped cross-section, is provided, which overlaps the base (1) in the manner of a box, and which comprises projections (57) on both sides of the armature, on which terminal pins of the base can be supported. Through the injection of sealing compound into the coil chamber (6), the construction obtains a high stability. In this way, with one and the same construction, conventional solder pin terminals, SMT terminals and press-fit terminals can be used. The stable main body can transmit high mechanical pressure forces to the press-fit terminal pins supported on it, or can also ensure stability against heat influences during SMT connections.

21 Claims, 9 Drawing Sheets

POLARIZED ELECTROMAGNETIC RELAY

BACKGROUND OF THE INVENTION

1. Field of the Invention

The present invention concerns generally a polarized electromagnetic relay, having

- a base made of insulating material, which with its floor side defines a main plane, and in which are anchored bearers for fixed contacts as well as contact terminal pins,
- a rocker armature arranged above the base, centrically seated on both sides, with an axis of rotation parallel to the main plane,
- a coil arranged above the armature, having an axis parallel to the main plane and perpendicular to the axis of rotation of the armature,
- a core arranged axially in the coil, having yokes at both ends directed downwards, perpendicular to the main plane, which respectively form working air gaps with the ends of the armature,
- a permanent magnet arrangement that produces similar magnetic poles in the yokes and, via [or: above] the axis of rotation of the armature, a magnetic pole that is dissimilar thereto, and
- a contact spring arrangement that is fixedly connected with the armature via a sheath of insulating material, which arrangement works together with the fixed contacts of the base, corresponding to the armature motion.

2. Description of the Related Art

A relay of the type described above is disclosed in PCT International Application WO 94/22156. There, a coil body is placed immediately on the base, which coil body, in addition to the coil winding and the core, also bears the yoke and the permanent magnet, and which is directly connected with the base in the side areas. A cap built over the coil body is connected with the base to form a closed housing. This known construction is designed for use with a conventional solder terminal technique; the connection structure of base and coil body is however not designed for heavier mechanical or thermal loads. Since, however, for the assembly of circuit boards using a surface mounting technique (SMT) and a terminal technique with press-fit pins are increasingly desired in miniature circuits in addition to conventional electrical contacting via solder terminal pins, the construction of relays should allow them to withstand as much as possible the mechanical or, respectively, thermal loads associated with these techniques, without deterioration of the precisely set characteristics of the relay.

From the German Published Patent Document DE 27 23 430 A1, a rotating armature relay having a main body with an H-shaped cross-section is also already known, which divides a coil chamber on the lower side from a contact chamber on the upper side. However, the construction there requires relatively long contact terminal elements embedded in the side walls of the main body. The connection of these terminal elements in the contact chamber on the upper side is moreover not suited to receive the pressure load for press-fit pins, nor can surface mounting techniques be performed without risk to the contact arrangement of exposure to the heat load.

SUMMARY OF THE INVENTION

An object of the present invention is to provide a polarized relay of the type described above so that, on the one hand, the insulation between the contacts and the coil is improved, and, on the other hand, the construction is made more stable overall, so that the desired characteristics of the relay are easily set and more securely maintained during handling or, respectively, during operation of the relay. In particular, a basic construction is thereby to be created that is suited, solely through the installation of different terminal elements, both for a solder pin connection and for a SMT connection and a press-fit connection.

According to the invention, this and other objects and advantages are achieved in the aforementioned relay construction in that a main body made of insulating material is provided that forms a dividing wall (with recesses for the yokes) parallel to the main plane, between the armature and the coil, and in that the main body is interleaved with the base by means of side walls, and together with this base forms an at least partially closed switching chamber, and in that the main body comprises a projection on both sides of the armature under which the contact terminal pins, that are respectively arranged in a row, are located, and which is suitable as a support area for these terminal pins as needed.

A high rigidity and stability of the relay construction results from the inventively provided main body. The adjustments set in manufacturing are thus securely maintained, even if external mechanical or thermal loads act on the relay housing. These advantages of a more stable construction also come into play when the support areas provided on both sides of the armature are not needed for the support of the terminal pins since only simple solder terminal pins, which are bent from the circuit boards and are injected in the base, are provided.

However, the present construction is particularly effective if terminal pins are used that extend from the base perpendicularly upwards to the respective support area of the main body. In order to avoid an overdefinition during production, it is usefully provided that the terminal pins are respectively in grooves of the main body and are fixed there by means of a sealing compound that can be hardened. In this way it is possible that after the assembly of the armature, with a precise setting of the contact distance of the base, the magnet system connected with the main body can be pushed onto the base until the armature lies exactly on the magnet system or, respectively, the predetermined air gaps have reached the yokes. Through the pouring in of adhesive or, respectively, sealing compound, the main body can then on the one hand be connected with the base so as to form a seal, whereby the terminal pins are embedded in the mentioned grooves in a preceding or simultaneous work phase. In this way there is provided a sealed, stable switching chamber that is insulated against the coil. In comparison to relays of similar construction, this switching chamber also has a very small air volume, since the coil chamber is not included in the air volume of the switching chamber. This is particularly advantageous should a stronger thermal effect, such as, for example, during the soldering of the relay, in particular during the reflow soldering of SMT terminals, be imposed on the relay.

The main body of the relay forms side walls that are closed at least around the contact chamber, so that the otherwise required housing cap can be omitted. A particularly advantageous embodiment provides that the main body is of an H-shaped cross-section, with a tub-shaped, upwardly open coil chamber that accepts the coil. It is quite useful that the coil chamber is filled either completely or at least partially with a sealing compound, by which means the rigidity of the construction is further increased. This is particularly advantageous if the relay is provided with press-fit terminal pins that are anchored in the main body in the way mentioned above. In this case, the press-fit equipment can press immediately on the encapsulated coil chamber, whereby the press-fit forces are transmitted to the terminal pins via the main body, and there is no danger of the settings in the relay being affected. On the upper side of the coil chamber, a cover plate can be attached if necessary. The coil chamber may be closed at it upper side with this cover plate. The cover plate can be metallic or can comprise a metallic outer layer, in order to work as a heat shield, particularly during surface mounting techniques (SMT).

A further feature of the relay is that the permanent magnet arrangement may comprise a bar-shaped, three-pole magnetized permanent magnet, fastened in the main body underneath the dividing wall between the yokes. The permanent magnet is preferably clamped between vertical wall segments of the main body.

The contact spring arrangement comprises two contact springs arranged in one plane, whereby each contact spring respectively comprises a flexible terminal segment led out laterally in the seating area of the armature, which segment is connected with a terminal pin anchored in the base. The terminal segments simultaneously serve as bearing strips for the armature. In the area of the seating of the armature, horizontal bearing pegs are respectively integrally formed laterally onto the insulating sheath connected with the armature, which pegs lie in corresponding bearing shells of the main body. The terminal segments of the contact springs each form one-piece integrally formed terminal pins, which are led outward through openings of the base.

Printed conductors of a pre-stamped board, which are embedded in the base in one plane, respectively form bearers for the fixed contacts, terminal segments, which are bent upward if necessary, for the contact springs, and terminal pins that are led out vertically downward. The printed conductors embedded in one plane in the base respectively form bearers for the fixed contacts, and terminal pins standing perpendicular to the main plane and penetrating through the plane of the printed conductors are connected with these, and are supported with their upper ends on the projection of the main body. The ends of the terminal pins emerging at the underside of the base are formed into pressfit stems. The ends of the terminal pins emerging at the underside of the base are formed into SMT terminal lugs. The end segments at the upper side of the terminal pins in the area of the projection of the main body protrude into a downwardly open groove and are fixed in this groove by hardened sealing compound.

In the base underneath each armature wing is provided a testing and ventilation opening.

The terminal lugs respectively comprise a meander-shaped segment in the area between the sheath and their passage through the opening of the base. The terminal lugs of the contact springs are respectively sheathed with a closing stopper that closes the opening in the base. Preferably, the terminal lugs of the contact springs are fixed in the opening of the base with a closing peg protruding downward from the main body.

BRIEF DESCRIPTION OF THE DRAWINGS

The invention is further defined below by means of exemplary embodiments shown in the drawings.

DETAILED DESCRIPTION OF THE PREFERRED EMBODIMENTS

Figure 1:
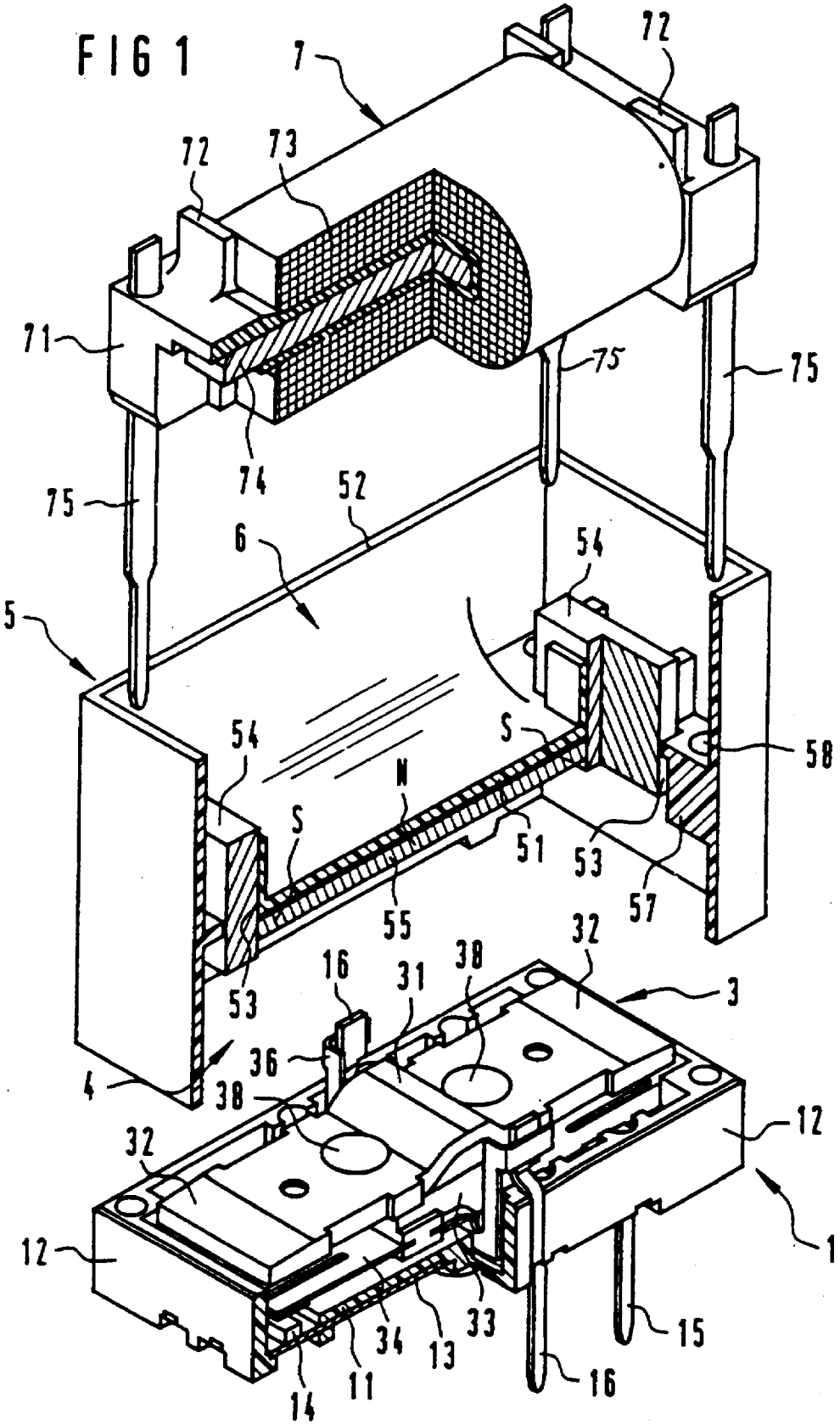
FIG. 1 shows the main modules of an inventively constructed relay before assembly, in a partly sectional perspective representation.
Figure 2:
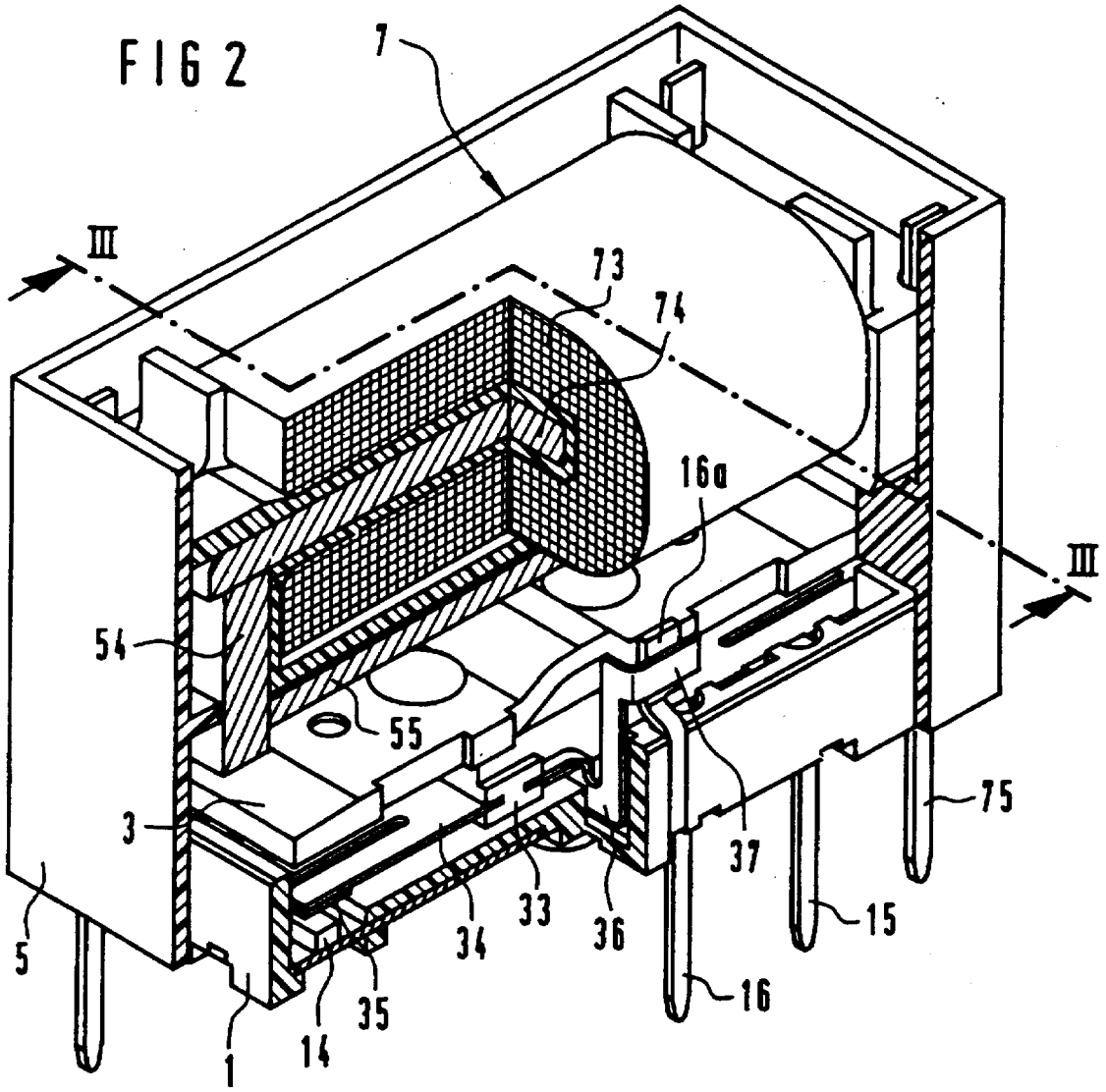
FIG. 2 is a perspective view of the relay of FIG. 1 in the assembled state.
Figure 3:
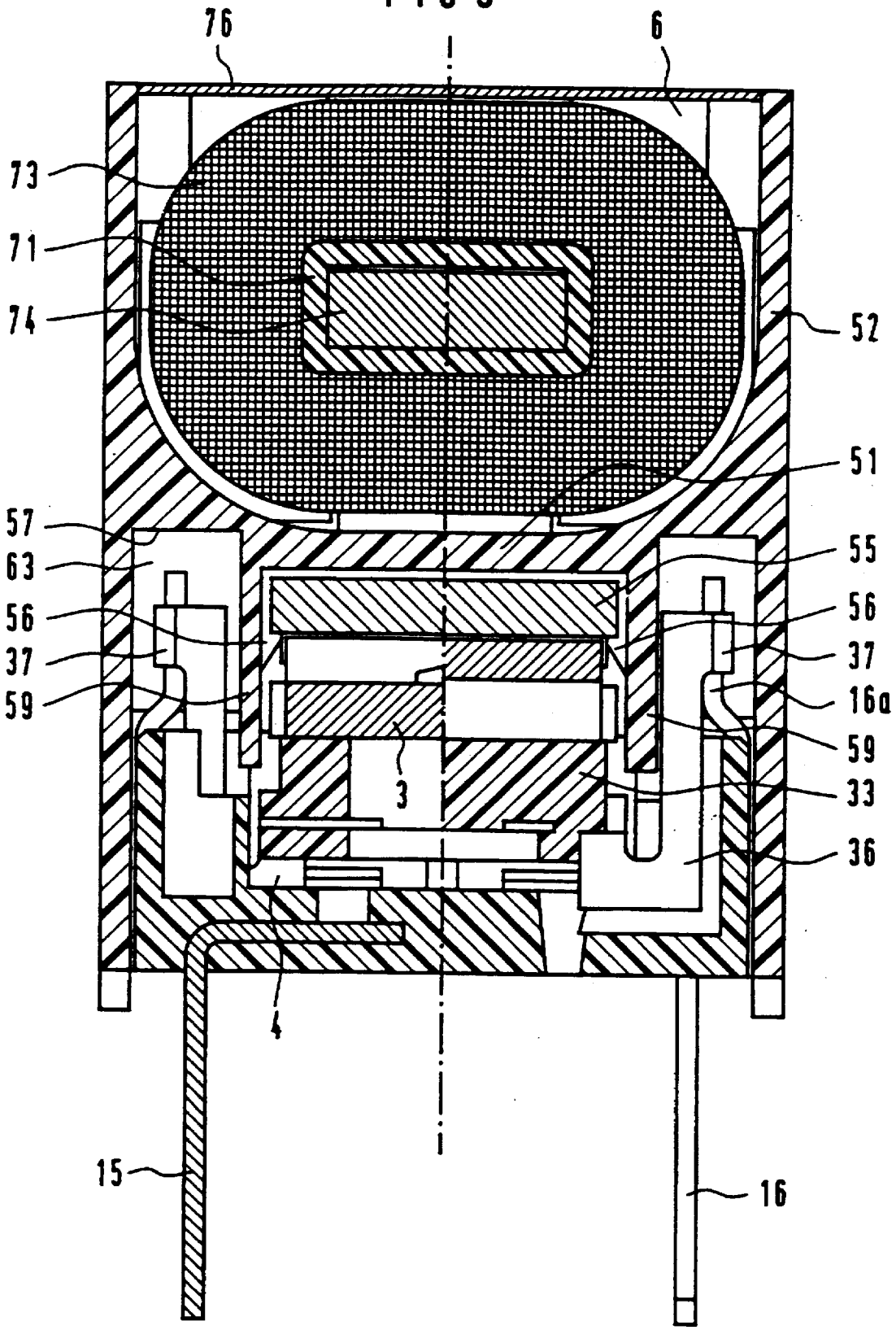
FIG. 3 is a section through the relay of FIG. 2 along line III—III, sectioned in a somewhat displaced manner on either side of a center plane.

The relay shown in FIGS. 1 to 3 essentially consists of a base 1 with an armature 3 arranged rotationally above the base. A main body 5 receives the base from below, and with it forms a closed contact chamber 4. Moreover, the main body 5 forms an upwardly open coil chamber 6 in which is inserted a coil 7.

The base 1 has a flat floor 11 that defines the main plane of the relay, as well as partly raised surrounding sides 12. Contact bearers 13, which are freely stamped from a metal board 8 and having open fixed contacts 14, are embedded in the insulating material of the base, parallel to the main plane; terminal pins 15, that are oriented downwards, are integrally formed in one piece with the contact bearers, which pins usually serve as solder terminals. In addition, contact spring terminal pins 16 made of the board material are respectively embedded in the side walls, whose upward extensions serve as bearing supports 16*a* for the armature 3.

The armature 3 consists of an essentially elongated ferromagnetic plate that has in its center segment a bearing curvature 31, bent upwards in order to define a roll axis situated across its longitudinal extension. The two wings of the armature respectively define pole faces 32 at their end segments. Underneath the armature is arranged a movable contact arrangement with a sheath of insulating material 33, in which two elongated contact springs 34 are embedded in one plane next to one another in such a way that their ends respectively lie open under the armature ends, and there respectively bear movable contacts 35, which work together with the fixed contacts 14 lying thereunder. Each contact spring has a bearing strip 36 that emerges from the sheath 33 in the side area and is shaped in the form of a bow in the area of the armature bearing and is bent into a vertical position, which strip is welded, with a corresponding fastening segment 37, to an associated contact spring terminal pin 16, or is conductively connected with this pin in some other way. The sheath of insulating material 33 has pegs 38 integrally formed upwards, which are plugged through borings of the armature 3 and are deformed on its upper side so that the movable contact arrangement having the contact springs 34 is fixedly connected with the armature 3, and thus participates in its switching motion. During the assembly of the armature 3 to the base 1, the desired contact distance between the movable contacts 35 and the fixed contacts 14 is first suitably set, before the bearing strips 36 are connected with the terminal pins 16.

The main body 5, which is made of insulating material, has a generally H-shaped cross-section having a dividing wall 51 parallel to the main plane and surrounding side walls 52, which together with the dividing wall 51 form the mentioned switching chamber 4 downwards and the coil chamber 6 upwards. Two ducts 53 are left open in the dividing wall 51, into which two ferromagnetic yokes 54 are inserted, standing vertically. Between the lower ends of the two yokes 54, a bar-shaped permanent magnet 55 is fastened between clamping ribs 56 (see FIG. 3). The permanent magnet is magnetized with three poles in such a way that via the armature axis it centrically produces a permanent magnet pole (N) and, at the two ends, two poles (S) opposed thereto. Projections 57 are integrally formed along the two longitudinal sides of the main body 5 underneath the dividing wall 51, which projections lie above the terminal pins 15 and 16 and can serve as support areas for correspondingly elongated terminal pins if necessary. In each case, these projections provide an additional rigidity of the main body; specific embodiments are further described below.

The coil 7 has a coil body 71 made of insulating material, on which a winding 73 is arranged between flanges 72. A core 74 is arranged in an axial traversing opening of the coil body. In addition, coil terminal pins 75 are respectively anchored in the flanges 72.

During mounting, the coil 7 is inserted into the coil chamber 6 of the main body from above, whereby the coil terminal pins 75 are plugged through corresponding holes 58 of the main body. The coils are subsequently fixed in the main body with sealing compound, whereby the yokes 54 and the permanent magnet 55 are also glued. The ducts are thereby also tightly closed. By filling of the coil chamber 6 with sealing compound, a very stable bond arises, which also makes it possible to withstand high mechanical loads. Above the coil is arranged e.g. a plate 76 that offers a flat surface for labeling. The plate can be made of metal or can be coated with metal such as on the outside surface, so that it forms a heat shield if the relay is exposed to a high heat radiation, e.g. in SMT mounting.

Figure 8:
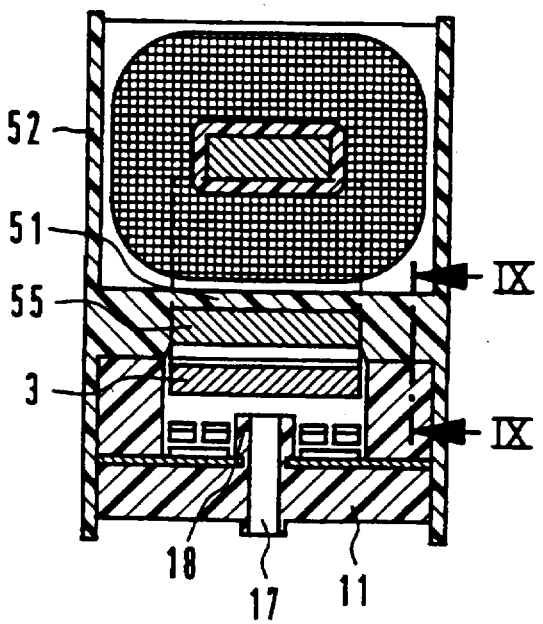
FIG. 8 is a cross-sectional view of the relay of FIG. 6 along line VIII—VIII.

Afterwards, the base 1, which has been pre-mounted with the armature 3, is set into the switching chamber 4 of the main body, whereby the side walls 52 of the main body overlap the side walls 12 of the base in the manner of a box. The base 1 is pushed on so far that the bearing 31 lies more or less on the permanent magnet 55 and the armature can alternatively lie on one of the yokes. The switching mobility of the armature can be checked by introducing a testing pin through ventilation openings 17 (which are visible in FIG. 8) and measuring the switching motion with the testing pin. For this purpose, two ventilation or, respectively, test openings 17, one each under each armature wing, are provided. These are located in the middle, between the two contact springs in the area of a raised insulating bar 18. After the setting of the precise position between the armature and the permanent magnet or, respectively, yokes, the base 1 is fixedly connected with the main body 5, preferably through the injection of sealing compound or adhesive into the edge gap between the respective side walls. The ventilation and test openings 17 are separately closed later.

Figure 4:
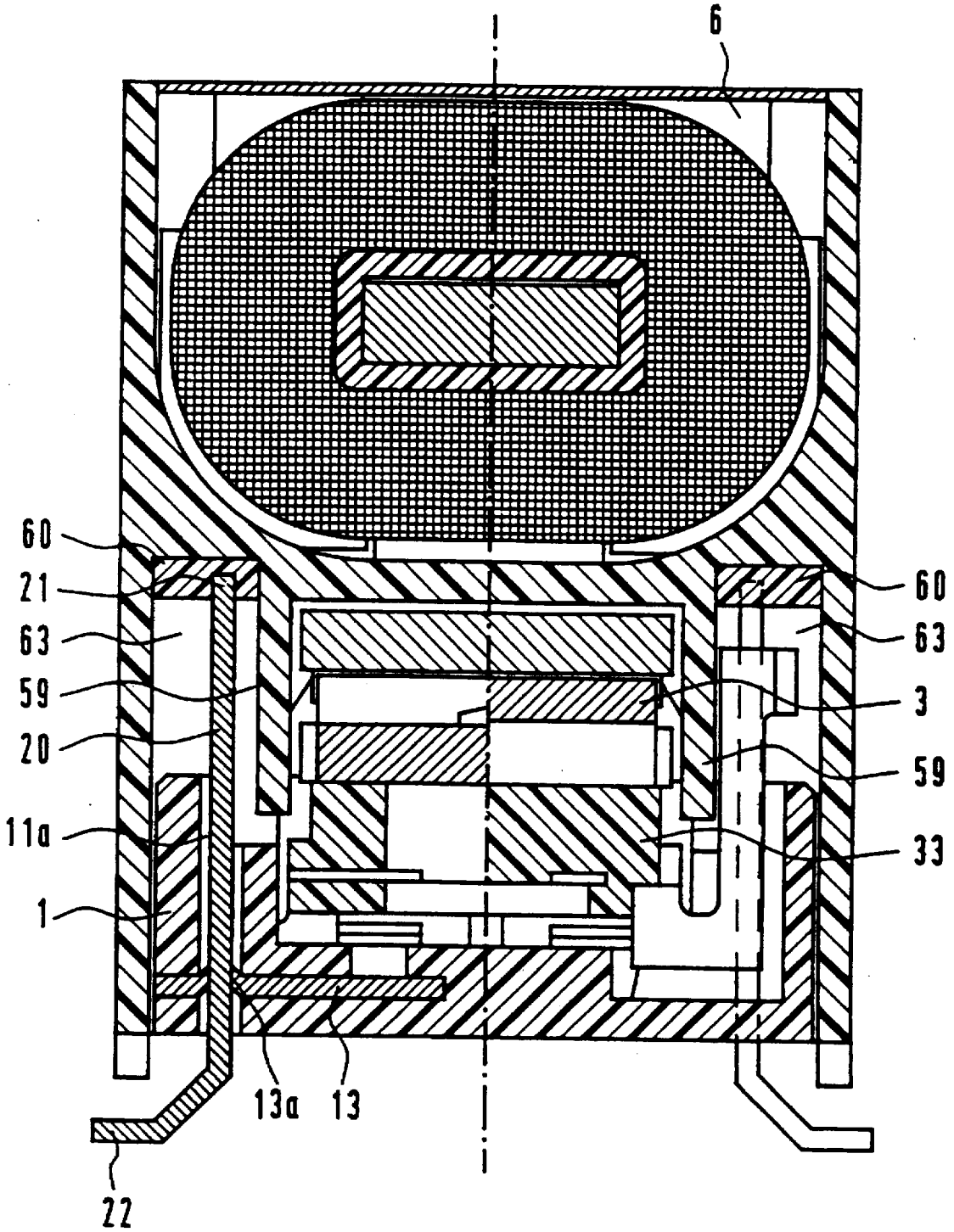
FIG. 4 is a section corresponding to FIG. 3 through a relay with SMT terminal pins.
Figure 5:
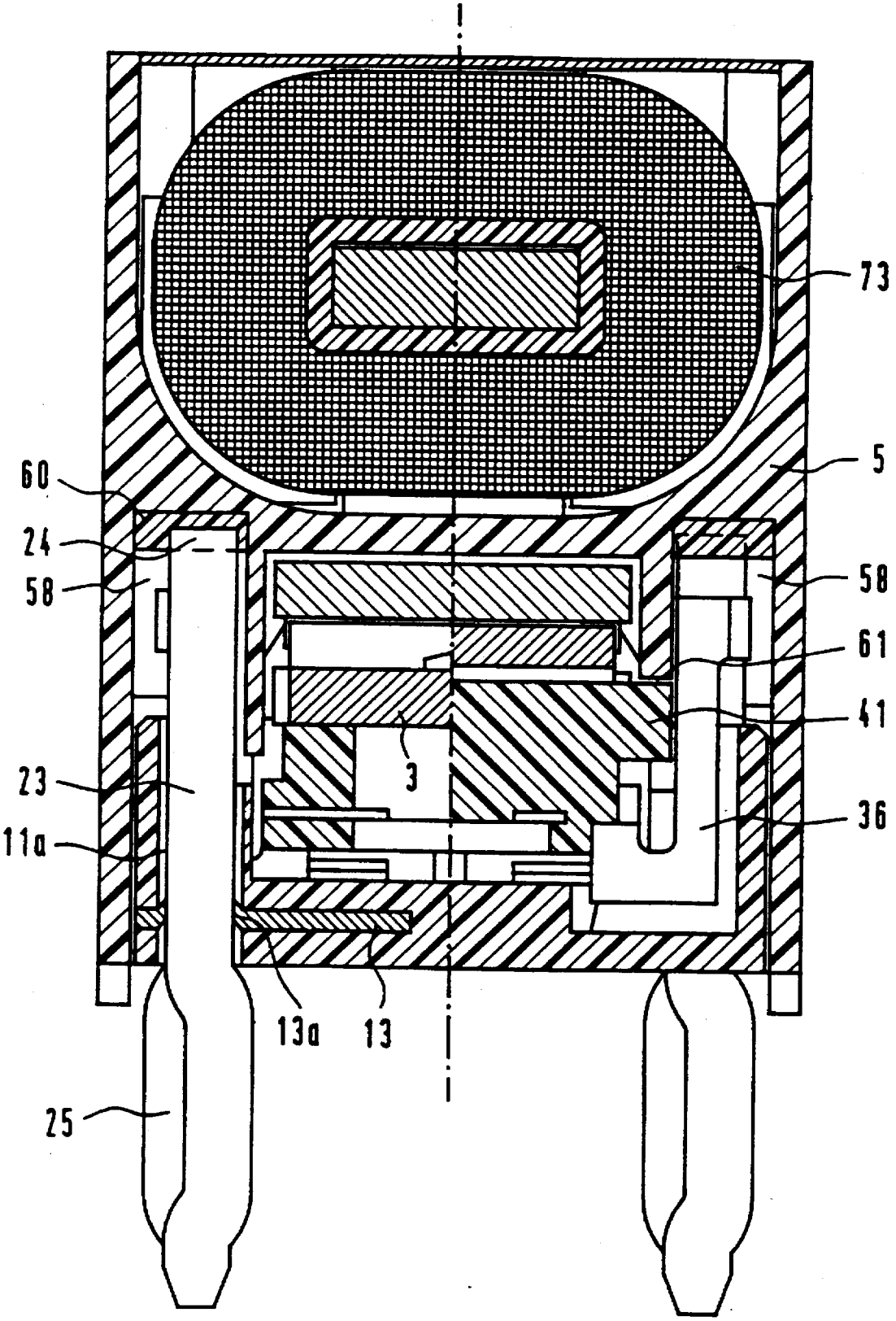
FIG. 5 is a section corresponding to FIG. 3 through a relay with press-fit terminal pins.

As can be seen for example in FIGS. 3, 4 and 5, in the contact chamber underneath the projections 57 a groove 63 is respectively formed that is bounded by the outer wall 52 of the main body and by a wall bar 59. This wall bar 59 forms at the same time an insulation between the metal parts of the armature and the terminal elements or, respectively, bearing strips 36 of the contact springs. As is shown in FIGS. 4 and 5, sealing compounds can be injected into these grooves 63 in order to anchor terminal pins that project in solidly in the main body; the rigidity is also additionally thereby increased. In FIG. 4, an embodiment of terminal pins 20 is thereby shown that is plugged through the injected board of the contact bearer 13 in the base area and is contacted with this board in a suitable way in openings 13*a*. The terminal pins 20, which have a rectangular cross-section, are anchored at their upper end segment 21 in the sealing compound 60 and respectively bent outward with their lower end in the form of SMT terminal lugs 22.

In FIG. 5, round terminal pins 23 are anchored in the same way in the base and contacted with the bearer board 13. In addition, here as well the upper end segments 24 are anchored in the sealing compound 60, while the lower ends in this case are formed into press-fit stems 25. Of course, here all possible types of press-fit zones are possible; moreover, in place of the round cross-section shown, the press-fit pins can also have a rectangular cross-section as in FIG. 4, or can have some other cross-sectional shape. In addition, the relay according to FIGS. 4 and 5 is constructed in the same way as, or similar to, that previously shown; however, slight modifications are possible within the scope of the invention.

A particularly simple type of fastening and contacting of the terminal pins 20 or, respectively, 23 is that openings 13*a* are made in the board forming the contact bearer 13, which openings have a somewhat smaller cross-section than the pins 20 or, respectively, 23 to be plugged through. According to the shape of the cross-section of the pins, these openings 13*a* are also of round or rectangular construction. The openings 11*a* in the base 1 or, respectively, in the base floor 11, are on the other hand somewhat larger in cross-section than the pins 20 or, respectively, 23, so that the edge of the openings 13*a* lies somewhat open around the pins. During the press-fitting of the terminal pins 20 or, respectively, 23 with a correspondingly large force into the openings 13*a*, the edge of the relevant opening 13*a* thus lies on the outer surface of the respective pin 20 or, respectively, 23 with a slight deformation. By means of this penetration between the contact bearer board 13 and the respective terminal pin 20 or, respectively, 23, a permanent tension arises that ensures the desired contacting.

Figure 6:
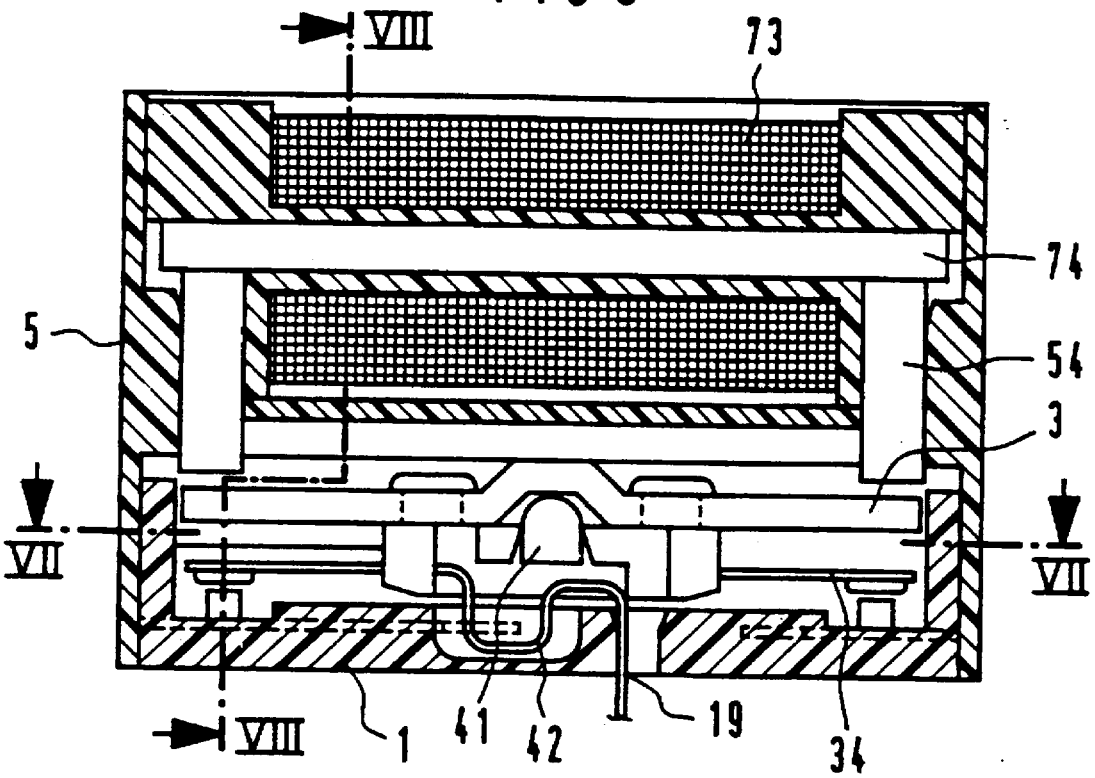
FIG. 6 is a partly sectional side view of a relay with an armature and contact arrangement that is modified in relation to FIG. 1.
Figure 7:
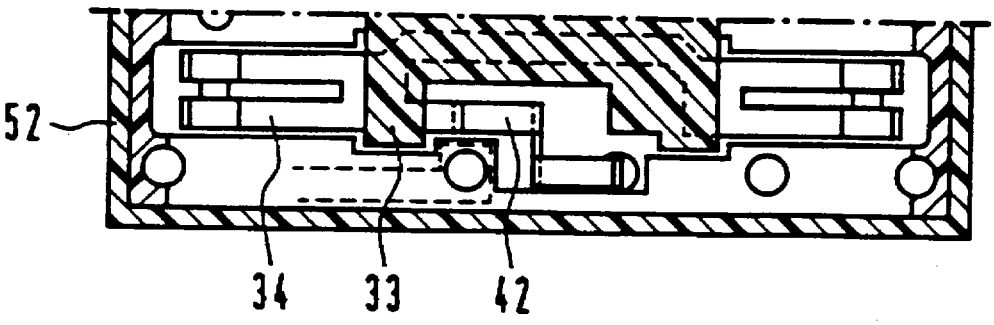
FIG. 7 is a sectional view from above of half of the armature of FIG. 6 along line VII—VII.
Figure 10:
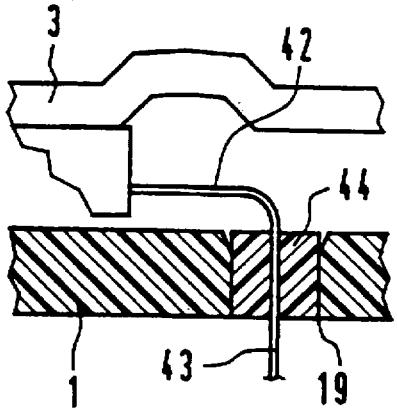
Figure 9:
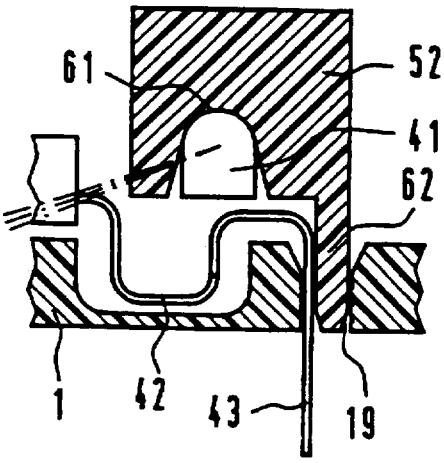
FIG. 9 is an enlarged detail sectional view of the armature seating and the contact spring terminal of the relay according to FIGS. 6 to 8.

In FIG. 5, a laterally protruding bearing peg 41 is additionally shown in the right half of the armature representation, which peg lies in a bearing shell 61 of the main body or, respectively, of the wall bar 59. In this way the armature can be positioned more precisely in relation to the main body and to the permanent magnet 55 if necessary. The seating is thereby more independent of the shape and the characteristics of the bearing strips 36. These bearing strips 36 are dispensable in this case and can be replaced by a simple flexible terminal segment 42, as shown in FIGS. 6 and 7. The area of the armature seating in FIG. 6 is shown in detail once again in FIG. 9, whereby here the section is displaced somewhat outwardly into the side wall of the main body in order to show the bearing shell 61. The meander-shaped terminal segment 42 has in this case a one piece integrally formed terminal pin 43, led outward through an opening 19 of the base. By means of a closing peg 62, integrally formed onto the main body, the opening 19 is closed and the terminal pin 43 is fixed. FIG. 10 again shows, in a schematized representation, the bearing part of the armature from the side. In this case, a simply bent terminal segment 42 is provided with an additional molded-on closing piece 44, which is plugged into the opening 19 of the base with the terminal pin and closes this opening.

Figure 11:
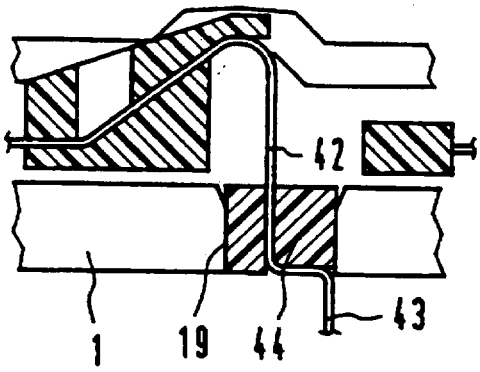
FIGS. 11 are two modified embodiments of the contact spring terminals, in enlarged side views comparable to FIG. 9.

FIG. 11 shows a further modified embodiment of the bearing detail. In this case, the terminal segment 42, in its horizontal part that leads obliquely upwards, is molded around from the sheath 33 of the contact arrangement, so that only the vertical part has a spring action. In this case as well, a closing piece 44 is molded onto the terminal segment.

Figure 12:
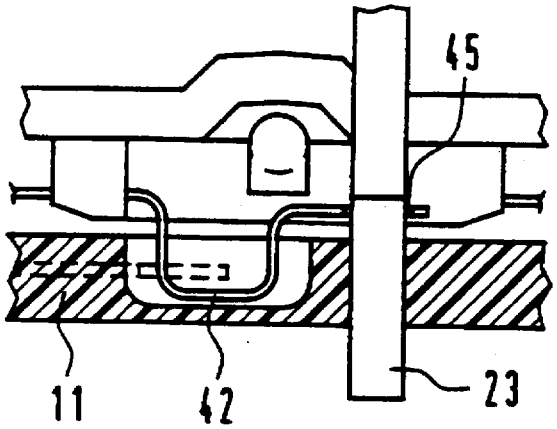
FIG. 12 is a further modification of a contact spring terminal and of the armature seating, in a partly sectional enlarged side view.

FIG. 12 shows, in a further modification, that a meander-shaped or otherwise shaped terminal segment 42 can also be connected with a massive terminal pin 23 anchored in the base, in place of an integrally formed thin terminal pin, in a way similar to FIG. 5. In this case, the terminal pin 23 is plugged through a recess 45 of the terminal segment 42, and is conductively connected with this segment in a way not shown in more detail.

Figure 13:
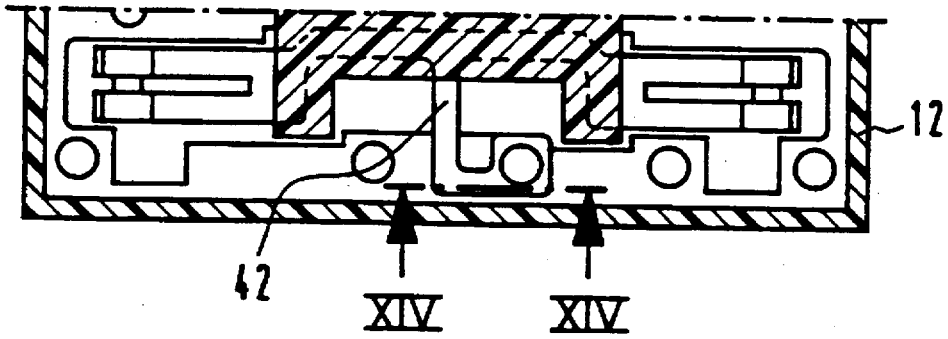
FIG. 13 is a sectional top view, comparable to FIG. 7, of an armature half in a modified embodiment.
Figure 14:
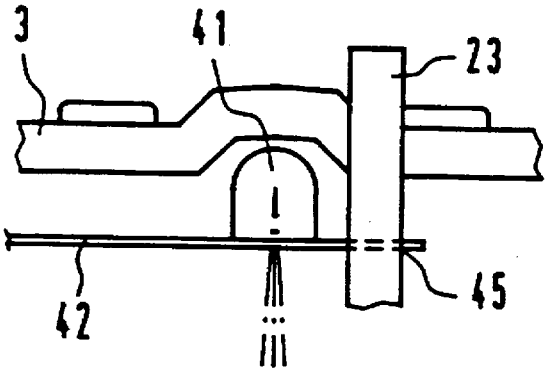
FIG. 14 is an enlarged side view of the armature seating of FIG. 13.

In FIGS. 13 and 14, a further modification is shown in two detail views, whereby the armature is seated as before over a bearing peg 41, and the contact springs are respectively connected with a round terminal pin 23 via a terminal segment 42 that runs outward from the armature as a torsion bar parallel to the bearing axis.

Figure 15:
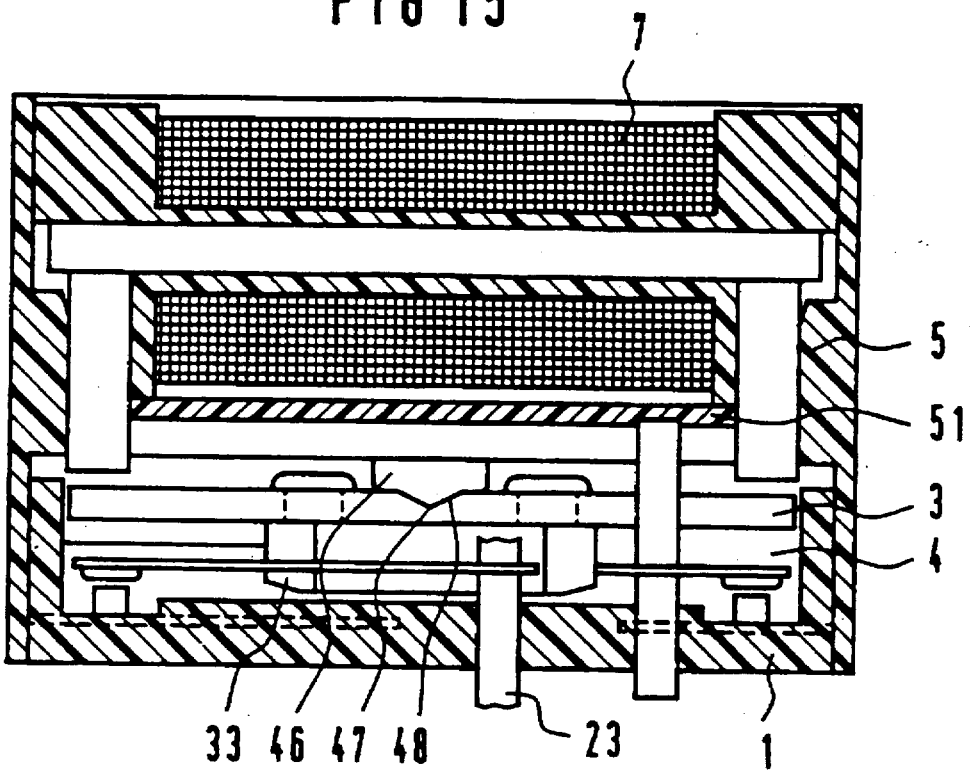
FIGS. 15 and 16 is a further embodiment of a relay, in two views, namely a side sectional view and a top sectional view.
Figure 16:
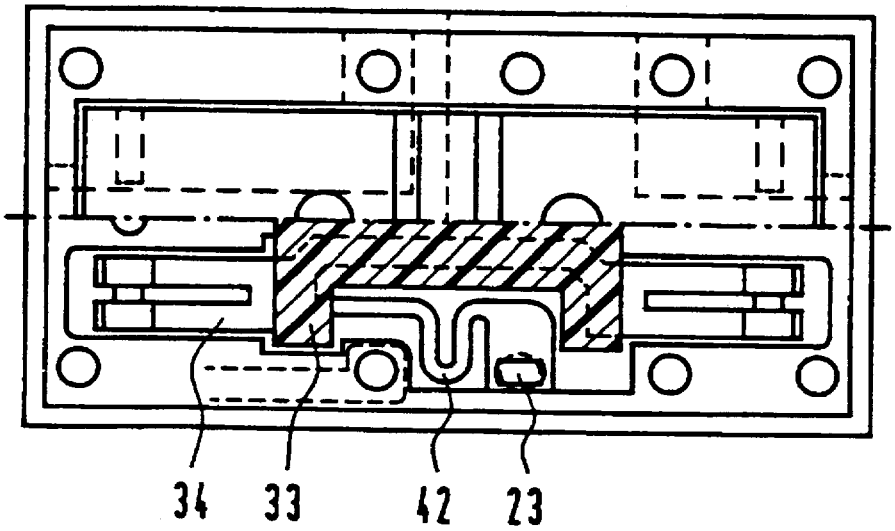

A further modification of the armature seating is shown in FIGS. 15 and 16, which largely correspond to the representation in FIGS. 6 and 7. In a modification of the exemplary embodiment shown there, here according to FIG. 15 the armature is seated on the permanent magnet 55 via an additional bearing piece 46, which forms a bearing edge 47. The armature has a bearing notch 48 formed into its axial area, which, like the bearing edge, can comprise an arbitrarily obtuse angle, or can also be rounded off. The contact springs 34 are in this case connected with a terminal pin 23 via a meander-shaped terminal segment 42.

Further modifications are possible; in particular, individual elements from the various examples, in particular the various armature seatings and contact spring terminals, can be combined with one another.

Although other modifications and changes may be suggested by those skilled in the art, it is the intention of the inventors to embody within the patent warranted hereon all changes and modifications as reasonably and properly come within the scope of their contribution to the art.

We claim:

1. A polarized electromagnetic relay, comprising:

a base of an insulating material, said base having a floor side which defines a main plane;

fixed contacts and contact terminal pins;

bearers in which are mounted said fixed contacts as well as said contact terminal pins anchored in said base;

a rocker armature arranged above said base and centrically seated on both sides with an axis of rotation parallel to said main plane;

a coil arranged above said armature, said coil having an axis parallel to said main plane and perpendicular to said axis of rotation of said rocker armature;

a core arranged axially in said coil, yokes at both ends of said core directed downwards perpendicular to said main plane, said yokes respectively form working air gaps with ends of said rocker armature;

a permanent magnet arrangement having similar magnetic poles at said yokes and a magnetic pole that is dissimilar thereto above said axis of rotation of said rocker armature;

a sheath of insulating material;

a contact spring arrangement fixedly connected with said rocker armature via said sheath of insulating material so that said contact spring arrangement works together with said fixed contacts of said base corresponding to motion of said rocker armature;

a main body made of insulating material that forms a dividing wall parallel to the main plane between said rocker armature and the coil, said main body having recesses for said yokes, said main body having side walls affixed to said base so that together said side walls and said base forms an at least partially closed switching chamber; and projections in said main body on both sides of said rocker armature under which said contact terminal pins are located arranged in rows, and which is a support area for said terminal pins as needed.

2. A polarized electromagnetic relay according to claim 1, wherein said main body is of an essentially H-shaped cross-section, and said coil is arranged in an upwardly open tub-shaped coil chamber of said H-shaped main body.

3. A polarized electromagnetic relay according to claim 2, further comprising:

sealing compound in said coil chamber to embed said coil at least partially.

4. A polarized electromagnetic relay according to claim 2, further comprising:

a cover plate mounted on said main body to close said coil chamber at an upper side.

5. A polarized electromagnetic relay according to claim 4, wherein said cover plate is comprised of metal.

6. A polarized electromagnetic relay according to claim 1, wherein said permanent magnet arrangement includes a bar-shaped, three-pole magnetized permanent magnet fastened in said main body underneath said dividing wall between said yokes.

7. A polarized electromagnetic relay according to claim 6, wherein said permanent magnet arrangement is clamped between vertical wall segments of said main body.

8. A polarized electromagnetic relay according to claim 1, wherein said contact spring arrangement includes two contact springs arranged in one plane, each of said contact springs has a flexible terminal segment led out laterally in a seating area of said rocker armature, said flexible terminal segment being connected with said contact terminal pins anchored in said base.

9. A polarized electromagnetic relay according to claim 8, wherein said flexible terminal segments simultaneously serve as bearing strips for said rocker armature.

10. A polarized electromagnetic relay according to claim 8, further comprising:

horizontal bearing pegs respectively integrally formed laterally onto said insulating sheath connected with said armature in an area of seating of said rocker armature, said horizontal bearing pegs lie in corresponding bearing shells of said main body.

11. A polarized electromagnetic relay according to claim 10, wherein said terminal segments of the contact springs respectively form one-piece integrally formed terminal pins which are led outward through openings of said base.

12. A polarized electromagnetic relay according to claim 1, wherein said bearers include printed conductors on a pre-stamped board embedded in said base in one plane, said pre-stamped board forming bearers for said fixed contacts, said terminal segments, for said contact springs, and said terminal pins.

13. A polarized electromagnetic relay according to claim 1, wherein said bearers include printed conductors embedded in one plane in said base for said fixed contacts, and said terminal pins standing perpendicular to said main plane and penetrating through the plane of said printed conductors are connected with these, and are supported with their upper ends on the projection of said main body.

14. A polarized electromagnetic relay according to claim 13, wherein ends of the terminal pins emerging at an underside of said base are formed into press-fit stems.

15. A polarized electromagnetic relay according to claim 12, wherein ends of the terminal pins emerging at an underside of said base are formed into SMT terminal lugs.

16. A polarized electromagnetic relay according to claim 13, wherein end segments at an upper side of said terminal pins in an area of said projection of said main body protrude into a downwardly open groove and are fixed in said groove by hardened sealing compound.

17. A polarized electromagnetic relay according to claim 1, further comprising means defining a testing and ventilation opening in said base underneath each armature wing.

18. A polarized electromagnetic relay according to claim 11, wherein said terminal lugs respectively include a meander-shaped segment in an area between said sheath and their passage through the opening of said base.

19. A polarized electromagnetic relay according to claim 11, further comprising:

a closing stopper sheathing said terminal lugs of the contact springs and closes said opening in said base.

20. A polarized electromagnetic relay according to claim 11, further comprising:

a closing peg protruding downward from said main body and fixing said terminal lugs of said contact springs in said opening of said base.

21. A polarized electromagnetic relay as claimed in claim 5, wherein said cover plate includes a layer of metal an upper side of said cover plate.

* * * * *